United States Patent [19]

Patton et al.

[11] Patent Number: 4,719,969

[45] Date of Patent: Jan. 19, 1988

[54] VIBRATION AND SHOCK RESISTANT HEAT EXCHANGER

[75] Inventors: William G. Patton, Severna Park; Victor H. Dilling, Chester; Geoffrey F. Green, Annapolis, all of Md.

[73] Assignee: The United States of America as represented by the Secretary of the Navy, Washington, D.C.

[21] Appl. No.: 739,349

[22] Filed: May 30, 1985

[51] Int. Cl.[4] ..... F28F 1/24; F28D 7/02

[52] U.S. Cl. ..... 165/160; 165/162; 165/163; 165/69; 62/55

[58] Field of Search ..... 165/160, 162, 163, 69

[56] References Cited

U.S. PATENT DOCUMENTS

| | | | |
|---|---|---|---|
| 2,896,669 | 1/1957 | Broadway et al. | 138/65 |
| 3,921,708 | 11/1975 | Brenner | 165/162 X |
| 4,116,270 | 9/1978 | Marushkin et al. | 165/163 X |
| 4,232,735 | 11/1980 | Kim et al. | 165/184 X |
| 4,250,927 | 2/1981 | Newburg | 138/113 |
| 4,285,396 | 8/1981 | Schwoerer et al. | 165/162 |
| 4,450,904 | 5/1984 | Volz | 165/163 X |

*Primary Examiner*—Albert W. Davis, Jr.
*Assistant Examiner*—Sue Hagarman
*Attorney, Agent, or Firm*—Luther A. Marsh

[57] ABSTRACT

A vibration and shock resistant finned tube counterflow heat exchanger comprising a rigid support member wound about the inner wall of the heat exchanger shell at the same pitch as the finned tube windings, and a radial bumper support, affixed to the unsupported end of the heat exchanger shell and providing a radial space between the concentric shells of the heat exchanger and an anterior insulating shell.

8 Claims, 5 Drawing Figures

VIBRATION AND SHOCK RESISTANT HEAT EXCHANGER

BACKGROUND OF THE INVENTION

Field of the Invention

The present invention relates generally to an improved finned tube heat exchanger, and more specifically to a finned tube support member and a radial bumper support means for reducing heat exchanger damage, efficiency loss, and failure due to vibration and shock loading.

In recent years there has been substantial interest in developing superconductive propulsion systems for marine vehicles. Modern marine vehicles have critical component restrictions. Size, weight and complexity are important considerations. A superconducting propulsion system is highly desirable because it is compact and light weight as compared to a comparable, traditional motor-generator system.

Superconducting propulsion systems incorporate helium liquefiers which operate at cryogenic temperatures and require a high efficiency heat exchanger. The magnet in a superconducting system must be cooled to an operating temperature approaching 0 degrees Kelvin. The system as a whole operates in normal room temperature. The helium liquefier therefore requires a heat exchanger which is highly efficient throughout a range from about 300 degrees Kelvin to about 4 degrees Kelvin.

A heat exchanger design presently used in other cryogenic systems, the conventional finned tube counter-flow heat exchanger, is unsatisfactory for shipboard operations. When a conventional finned tube counter-flow heat exchanger is subjected to the vibration and shock loading of the shipboard environment, the adjacent windings of the finned tube compress longitudinally and make contact. This creates a thermal short between the adjacent windings and seriously degrades the thermodynamic performance of the heat exchanger.

Prior attempts to prevent this thermal shorting have been unsuccessful. It is known in the conventional heat exchanger art to use a compliant spacer between the adjacent windings. This compliant spacer is satisfactory in other cryogenic applications, but not for shipboard operations. When subjected to the vibration and shock loading of shipboard operation, the adjacent windings of the finned tube wear through the compliant spacer, make contact, and cause thermal shorting. Attempts to prevent this thermal shorting by affixing the finned tube to the wall of the heat exchanger shell have also failed. Typically, the finned tube was soft soldered to the inner wall of the heat exchanger with random or periodic welds. These welds cause thermal shorting and obstruct the counter-flow. Furthermore, these welds are difficult to prepare because of the finned tube structure. The fins of the finned tube are fragile, and the welds are therefore prone to fail when subjected to the vibration and shock loading associated with shipboard operations.

Previous attempts to prevent the longitudinal compression of the finned tube windings are also unsatisfactory. Brenner, in U.S. Pat. No. 3,921,708, discloses the use of an expansion limiter in the form of a supporting jacket. The jacket, a helical channel with a rectangular cross section, is formed by a helical fin affixed to the inner and outer walls of the cylindrical heat exchanger shell. Each winding is firmly held within the supporting jacket by a four point support system. The four point support is provided by the inner wall, ridges located on each side of the support jacket fin, and set screws, located in the outer wall of the heat exchanger shell. The support jacket restricts the counter-flow of the heat exchanger. It causes the flow to process helically through the jacket, perpendicular to the finned tube fins. For peak efficiency, the flow should travel parallel to the finned tube fins. Brenner's device also requires set screw adjustments. It therefore reduces the efficiency and increases the complexity of the finned tube heat exchanger.

Another source of efficiency loss caused by the vibration and shock loading of a cryogenic finned tube counter-flow heat exchanger, is the damage and thermal shorting due to contact between the concentric cylindrical shells of the heat exchanger and insulating shell. The heat exchanger of a helium liquefier often comprises a series of concentric heat exchanger shells or shell segments. These heat exchanger shells are further contained in a concentric insulating shell, maintained at a vacuum approaching 1 micron of mercury to provide maximum thermal insulation. One end of the heat exchanger shell is rigidly held concentric to the insulating shell, but the other end of the heat exchanger shell, and any interior concentric heat exchanger shell segments, remain unsupported. When subjected to vibration and shock loading, the unsupported ends oscillate and may make contact. When the unsupported ends make contact, they cause thermal shorting. Shock loading and extended vibration cause fatigue at the rigid support and other joints of the shell walls. Sufficient material fatigue results in stress fractures and leakage between the heat exchanger shells and the vacuum-insulating shell, thereby reducing the heat exchanger efficiency.

For these and other reasons, the presently known heat exchangers are unsatisfactory for use in shipboard superconductive propulsion systems. A need exists for high efficiency cryogenic heat exchanger which retains its efficiency in the vibration and shock loading environment associated with shipboard superconductive propulsion systems.

SUMMARY OF THE INVENTION

It is therefore an object of the present invention to make a compact, simple design, high efficiency heat exchanger for shipboard superconductive propulsion systems.

It is another object of the present invention to make a finned tube counter-flow cryogenic heat exchanger resistant to damage and efficiency loss due to vibration and shock loading.

These objects and further advantages are achieved by the present invention, an improved finned tube counter-flow heat exchanger, comprising a finned tube support member and radial bumper supports. The support member is helically wound about, and affixed to, the inner wall of the heat exchanger shell. The pitch of the support member windings is the same as the pitch of the finned tube windings, thereby providing rigid support and spacing of the finned tube windings. Radial bumper supports are provided between the concentric interior heat exchanger shells and the anterior insulating shell.

BRIEF DESCRIPTION OF THE DRAWINGS

A more complete appreciation of the invention will become apparent from the following detailed description when considered in conjunction with the accompanying drawings wherein.

DETAILED DESCRIPTION OF THE PREFERRED EMBODIMENT

Figure 1:
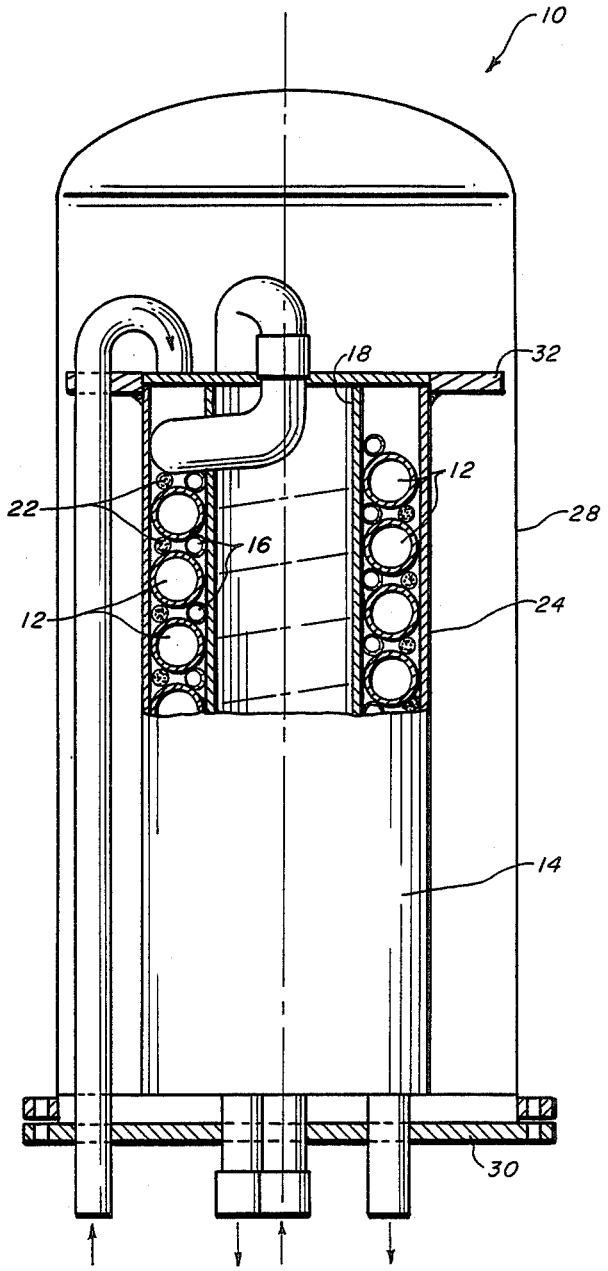
FIG. 1 illustrates an embodiment of the present invention.

Referring now to the drawings, and specifically to FIG. 1, there is generally illustrated a finned tube counter-flow heat exchanger 10. Heat is exchanged from a warm, high pressure stream inside a finned tube 12, to a colder, low pressure stream flowing in the opposite direction within a cylindrical heat exchanger shell 14. Each successive turn of the finned tube 12 is slightly colder than the preceding turn as the high pressure flow progresses against the cold, counter-flowing low pressure stream. To maintain the integrity of this thermal gradient, it is necessary to maintain a space between the adjacent windings of the finned tube 12. In the present invention, this space is provided by a support member 16 helically wound about, and affixed to, the inner shell wall 18 of the heat exchanger shell 14. The pitch of the windings of the support member 16 is predetermined to be the same as the pitch of the windings of the finned tube 12. A compliant spacer element 22 is helically wound about the helically wound finned tube 2, lies within the groove formed by adjacent windings of the finned tube 12, and provides flow direction control to the counter-flow. The heat exchanger shell 14 is contained within a concentric insulating shell 28. The interior of the insulating shell 28 is maintained at vacuum for maximum thermal insulation. A head support member 30 rigidly holds one end of the heat exchanger shell 14 concentric to one end of the insulating shell 28. A radial bumper support 32 is affixed to the unsupported end of the heat exchanger shell 14. The radial bumper support 32 extends radially outward, and maintains a space between the heat exchanger shell 14 and the insulating shell 28. A small gap is also provided between the radial bumper support 32 and the insulating shell 28.

This radial bumper support design provides several advantages. The radial bumper support 32 substantially reduces the loss of concentrically between the unsupported end of the heat exchanger shell 14 and the insulating shell 28 during vibration and shock loading. This prevents damage to both the unsupported end and the insulating shell. It also prevents damage to the joints of the supported end which are otherwise subjected to stress and fatigue from the vibration and shock loading. Damage at either end, of either shell, can cause leakage and reduce the efficiency of the heat exchanger 10. The small gap provided between the radial bumper support 32 and the insulating shell 28 prevents loss of efficiency due to the thermal shorting associated with constant contact.

Figure 2:
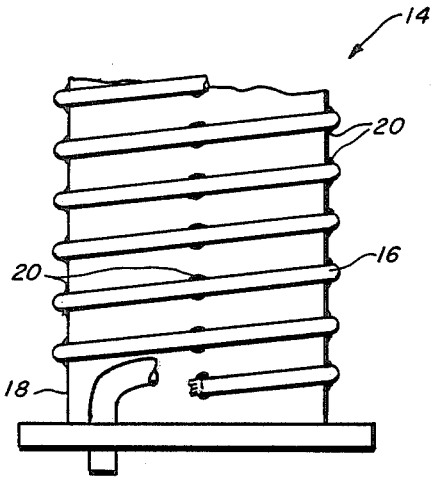
FIG. 2 illustrates the support member of the present invention.

FIG. 2 further illustrates the support member 16 of FIG. 1 The support member 16 is wound about the inner wall 18 of the heat exchanger shell 14. The windings are helical, and the pitch is predetermined to be the same as the pitch of the windings of the finned tube 12 in the counter-flow heat exchanger 10 of FIG. 1. The tubing size is also predetermined to maintain a space between adjacent finned tube windings. The support member 16 is affixed to the inner wall 18 of the heat exchanger shell 14.

The support member 16 may be constructed of any conventional material. The preferred material is 304 stainless steel tubing. This tubing provides maximum structural strength and durability with minimal thermal conductivity. It is also easy to weld to the heat exchanger shell wall. Other materials having comparable strength and thermal characteristics may clearly by substituted therefore.

The support member 16 may be affixed to the inner wall 18 of the heat exchanger shell 14 by an conventional means. The preferred method is by welding. In FIG. 2, periodic welds 20 are shown aligned in the longitudinal direction, with four welds 20 per turn of the support member 16, however, any method of welding which rigidly affixes the support member 16 to the heat exchanger shell 14 may be used. The number and frequency of welds 20 required to rigidly affix the support member 16 to the heat exchanger shell 14 is dependent on the radius of the helical windings, the size and mass of the finned tube 12, and the size and mass of the support member 16.

Figure 3:
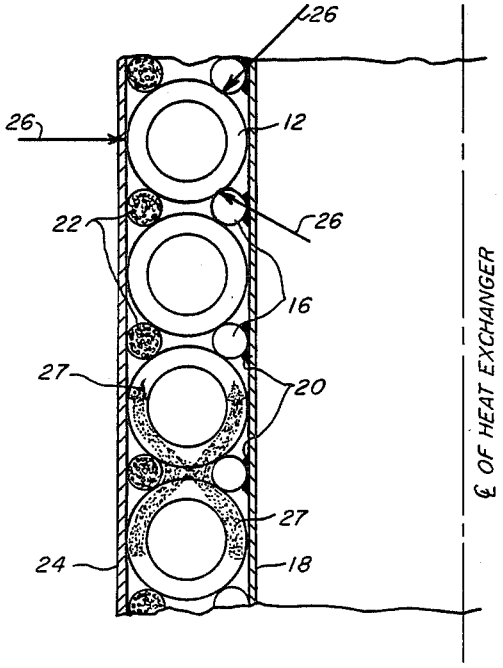
FIG. 3 illustrates the rigid support and counter-flow characteristics of the present invention.

Referring now to FIG. 3, the rigid support and heat exchange characteristics of the present invention are illustrated. The support member 16, the finned tube 12, and the compliant spacer element 22 are helically wound at the same pitch about the inner wall 18 of the heat exchanger shell 14. The support member 16 is affixed to the inner wall 18 of the heat exchanger shell 14 by welds 20. The compliant spacer element 22 lies within the groove formed by the adjacent turns of the finned tube 12 and the outer wall 24 of the heat exchanger shell 14.

The rigid support is a three point suppot system. Each turn of the finned tube 12 is rigidly supported by the adjacent turns of the support member 16 in co-operation with the outer wall 24 of the heat exchanger shell 14. This tripartite support is illustrated by pressure point arrows 26.

The efficiency of heat exchange in a finned tube heat exchanger is dependent on the flow characteristics of the counter-flow across the finned tube fins. For maximum efficiency, the counter-flow should traverse the entire fin surface. It is also imporant that the counter-flow not be obstructed. The greater the flow obstruction, the greater the counter flow pressure drop across the heat exchanger, and the greater the efficiency loss. The flow characteristics of the present invention are illustrated by arrows 27. The support member 16 and the compliant spacer element 22 direct the counter-flow across the entire fin surface without substantially obstructing the flow. As FIG. 3 illustrates, the counter-flow characteristic functions of the support member 16 and the compliant spacer element 22 are complimentary. Therefore, maximum efficiency results when the size of the compliant spacer element 22 is the same as the size of the support member 16.

FIG. 3 also illustrates the consistent spacing between the adjacent finned tube 12 windings provided by the support member 16 of the present invention. This consistent spacing, and the maintenance thereof during vibration and shock loading, is necessary for a highly efficient heat exchanger.

Figure 4:
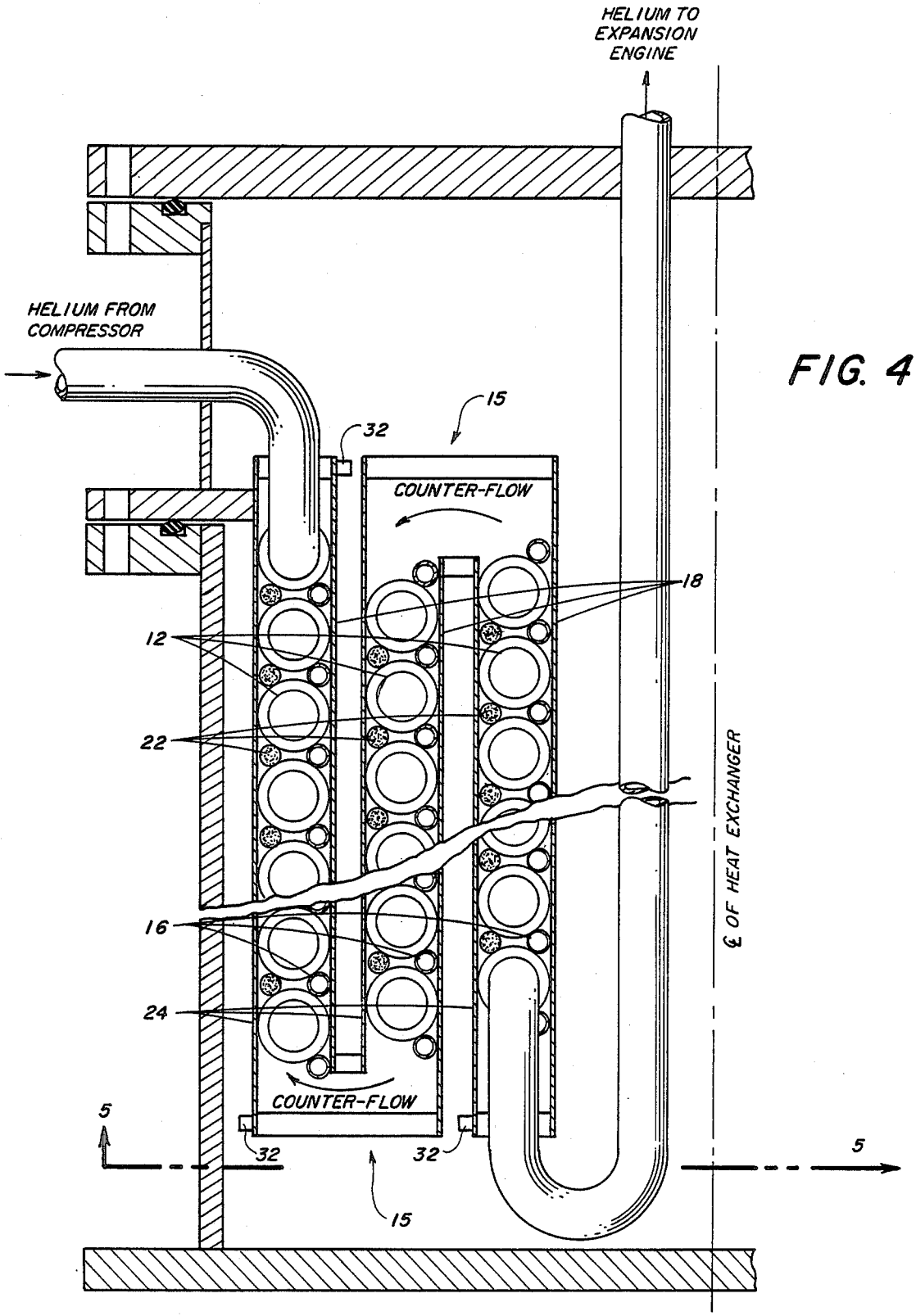
FIG. 4 illustrates the preferred embodiment of the present invention.

FIG. 4 illustrates the preferred embodiment of the present invention. The preferred embodiment is functionally equivalent to the embodiment illustrated in FIG. 1, however, the heat exchanger shell 14 is folded to comprise a series of concentric cylindrical shell segments. The advantages of this arrangement include its compact size and high efficiency.

The construction of each concentric cylindrical shell segment of heat exchanger shell 14 is substantially the same as the construction in the embodiment of FIG. 1. Each heat exchanger shell 14 segment comprises a helically wound finned tube 12 segment, a helically wound support member 16 segment, and a helically wound compliant spacer element 22 segment. Each support member 16 segment is affixed to the inner shell wall 18 of its heat exchanger shell 14 segment. Each turn of the finned tube 12 is rigidly supported within its heat exchanger shell 14 segment by a support member 16 segment in cooperation with the outer wall 24 of the heat exchanger shell 14 segment. The pitch of the helical windings within each segment is the same, however the radius and pitch of the windings varies with each respective concentric heat exchanger shell 14 segment.

The rigid support and the counter-flow characteristics of the preferred embodiment are the same as those illustrated in FIG. 3. Each turn of the finned tube has tripartite support. The counter-flow is substantially unobstructed and flows across the entire fin surface to maximize heat exchanger efficiency.

The preferred embodiment more clearly demonstrates the features and advantages of a radial bumper support 32. When the heat exchanger shell 14 is folded into concentric segments, it creates additional unsupported heat exchanger segment ends 15. This creates multiple additional freedoms of movement. The different segment ends 15 of the heat exchanger shell 14 can oscillate at different frequencies and modes, increasing the risk of damage and efficiency loss from physical contact and joint stress. By substantially reducing the freedom of movement, the radial bumper support 32 substantially reduces the risk of damage and efficiency loss.

In the preferred embodiment, each radial bumper support 32 comprises a plurality of tube segments constructed from 304 stainless steel tubing. These radial bumper supports 32 are lightweight, durable, and have low thermal conductivity. Other materials having these characteristics may clearly be substituted therefore.

Figure 5:
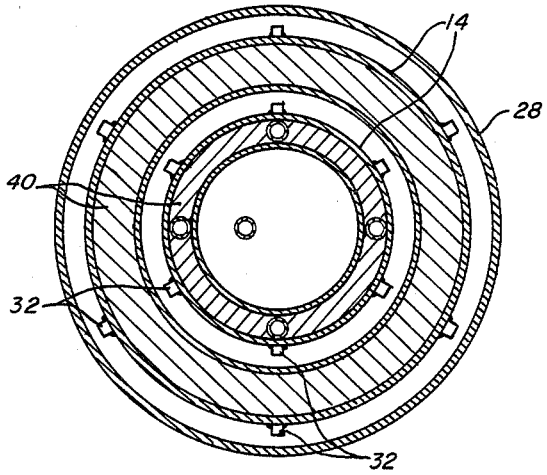
FIG. 5 illustrates the radial bumper supports of the preferred embodiment.

Referring now to FIG. 5, the radial bumper supports 32 of the preferred embodiment are illustrated in an end view along line 5—5 of FIG. 4. In the preferred embodiment, each radial bumper support 32 is comprised of six radially extending tube segments, equally spaced around, and affixed to, the circumference of an end ring 40 at each unsupported segment end 15 of the heat exchanger shell 14. The preferred method of affixing the radial bumper supports 32 is by welding.

ALTERNATIVE EMBODIMENTS

In an alternative embodiment, rigid support could be achieved by embossing a similar helix into the inner wall of the heat exchanger shell. This technique could speed up production and cut production costs.

In another alternative embodiment, a rigid support member may be affixed to the outer wall of the heat exchanger shell.

In yet another embodiment, multiple support members of the present invention may be adapted to heat exchangers having multiple finned tubes. For example, two finned tubes arranged in a double helix configuration would require two support members arranged in a similar double helix configuration.

Numerous modifications and variations of the present invention are possible in light of the above teachings. It is therefore to be understood that within the scope of the appended claims, the invention may be practiced otherwise than as specifically described herein.

We claim:

1. A vibration and shock resistant finned tube counter-flow heat exchanger comprising:

a cylindrical heat exchanger shell, having an inner shell wall and an outer shell wall;

a finned tube, helically wound about the inner wall of said cylindrical heat exchanger shell;

a support member, helically wound about, and affixed to, the inner wall of said cylindrical heat exchanger shell and having the same pitch as said finned tube windings, wherein said support member rigidly supports said finned tube, maintains a space between the adjacent finned tube windings, and directs the counter flow across the surface area of the finned tube fins; and, a compliant spacer element, helically wound about the finned tube windings, the windings of the compliant spacer element having the same pitch as the finned tube windings and lying within the groove formed between the adjacent windings of the finned tube and the outer wall of the heat exchanger shell, wherein said compliant spacer element maintains a space between the adjacent windings of the finned tube and directs the counter-flow across the surface area of the finned tube fins in co-operation with the support member.

2. The apparatus recited in claim 1, wherein the compliant spacer element is a soft cotton rope.

3. The apparatus recited in claim 1, further comprising:

an insulating shell, anterior and concentric to said cylindrical heat exchanger shell;

a head support member, rigidly maintaining one end of the cylindrical heat exchanger shell concentric to said thermally insulating shell; and, a radially bumper support, located radially between the unsupported end of the heat exchanger shell and the insulating shell, maintaining a radial space therebetween, and provided with a radial gap between said radial bumper support and said insulating shell.

4. The apparatus recited in claim 3, wherein the radial bumper support is affixed to the end ring of the cylindrical heat exchanger shell.

5. The apparatus recited in claim 3, wherein the radial bumper support is further comprised of:

a plurality of members, constructed from stainless steel tubing, equally spaced around, and extending radially from, the unsupported end ring of the cylindrical heat exchanger shell.

6. The apparatus recited in claim 5, wherein the number of members is six.

7. The apparatus recited in claim 5, wherein the stainless steel members are affixed to the cylindrical heat exchanger end ring by welding.

8. A vibration and shock resistant finned tube counter-flow heat exchanger, comprising:

a cylindrical heat exchanger shell, said shell being folded to further comprise a series of concentric cylindrical shell segments, each shell segment having a radially inner shell wall and outer shell wall;

a finned tube, helically wound within said heat exchanger shell, wherein said finned tube is helically wound about the inner wall of each heat exchanger shell segment;

a plurality of support members, at least one support member being located within each shell segment, each support member being helically wound about, and affixed to, the inner wall of its shell segment at the same pitch as the finned tube windings within said shell segment, wherein the adjacent windings of said support member rigidly support each turn of said finned tube in cooperation with the outer wall of said shell segment and further maintaining a consistent spacing between adjacent finned tube windings;

an insulating shell, conentric to and anterior to said heat exchanger shell;

a head support member, affixed to said insulation shell and one end of the outer-most shell segment of the heat exchanger shell, wherein said head support member maintains said shell segment end concentric to said insulating shell;

a first radial bumper support, further comprising a plurality of tube members, radially located between the unsupported end of the outer-most heat exchanger shell segment and said insulating shell, said radial bumper support members being equally spaced around, and affixed to, the unsupported end of said shell segment, and provided with a gap between each of said radial bumper support members and said insulating shell, wherein said radial bumper support members maintain a radial space between the unsupported end of said heat exchanger shell segment and said insulating shell; and, at least one additional radial bumper support, each further comprising a plurality of radially extending tube members, each radial bumper support being radially located between two adjacent interior heat exchanger shell segments, at least one shell segment of which is unsupported by said head support member, each tube member being affixed to the end ring of one of said adjacent interior shell segments, and provided with a gap between said additional radial bumper support members and the non-affixed shell segment, wherein said additional radial bumper supports prevent the ends of the adjacent shell segments from making contact.

* * * * *